US007156396B1

(12) United States Patent
Voden

(10) Patent No.: US 7,156,396 B1
(45) Date of Patent: Jan. 2, 2007

(54) COLLAPSIBLE GAME TABLE

(76) Inventor: Justin L. Voden, W244 S6945 Maple Hill Dr., Waukesha, WI (US) 53189

( * ) Notice: Subject to any disclaimer, the term of this patent is extended or adjusted under 35 U.S.C. 154(b) by 0 days.

(21) Appl. No.: 10/710,171

(22) Filed: Jun. 23, 2004

(51) Int. Cl.
*A63F 3/00* (2006.01)

(52) U.S. Cl. ..... 273/285; 273/309

(58) Field of Classification Search ..... 273/285, 273/309; 40/365, 366; 108/167
See application file for complete search history.

(56) References Cited

U.S. PATENT DOCUMENTS 2,774,599 A * 12/1956 Dunn ..... 273/280
3,964,403 A 6/1976 Schankman
4,015,778 A * 4/1977 Chen et al. ..... 273/284
4,041,880 A 8/1977 Schankman
4,579,342 A 4/1986 Mortensen
4,927,140 A 5/1990 Pappas
5,078,404 A 1/1992 Barillaro et al.
5,362,063 A 11/1994 Cummings
5,405,146 A * 4/1995 Washington ..... 273/157 R
6,041,722 A 3/2000 Baker
6,616,141 B1 9/2003 Diamant
6,634,646 B1 10/2003 Wolpert et al.

* cited by examiner

*Primary Examiner*—Vishu Mendiratta
(74) *Attorney, Agent, or Firm*—DeWitt Ross & Stevens SC; Charles S. Sara

(57) ABSTRACT

A folding game table having a collapsible construction is disclosed. The folding game table has a plurality of table top portions interconnected with at least one hinge and movable between an extended position and a folded position. At least one rail is configured to be removably mounted to the plurality of table top portions and configured to removably secure at least one game template to the plurality of table top portions.

18 Claims, 5 Drawing Sheets

10
12
16
16
20A
62
70
62
70
22
62
62
70
20B
20
64
64
68
62
70
60
68
14
64
24
64
64
60
60
68
64
64
24
68
66

COLLAPSIBLE GAME TABLE

BACKGROUND OF INVENTION

The present invention relates generally to game tables and, more particularly, to a multi-game collapsible game table.

Poker tables generally consist of a relatively flat surface with a felt or comparable material stretched over it. In order to maintain the quality and condition of the cover material of the table as well as reduce any obstructions to game play, players often prefer some additional space away from the play surface for food and drink as well as poker chips or other success/failure indicators. Additionally, the ancillaries associated with game play such as cards, dice, poker chips, and the like, should preferably be kept with a table in order to keep these related game-playing elements from being misplaced.

Another consideration of game table design is the collapsibility of the table system. These tables are often only used periodically and are frequently set up for game time and collapsed and stored shortly thereafter. It is often desirable to store the table in a minimum of space compared to the amount of space occupied by the table when it is set up. Some prior art tables have provided a collapsible leg system for the tables but do not provide means for collapsing the table surface. Other table systems provide a collapsible leg assembly in addition to a collapsing mechanism for the table surface but do not provide a continuous playing surface. That is, the joints formed when the individual components of the table portion are assembled to form the planar playing surface form a discontinuity, or a crack, in the playing surface. This joint, or crack, in the playing surface of the game table can interrupt the flow of playing cards or poker chips across the table thereby interrupting play and detracting from a gamer's enjoyment of the game being played.

In addition to the space, storage, and playing surface continuity considerations addressed above, another consideration to game table construction is game format. The game format is the game pattern or indicia that are provided on the game playing surface to aid in game flow. Several game formats that can be provided on the game playing surface include a roulette, craps, poker, cricket, dog track, and blackjack to name but a few. Depending partly on which game is to be played on the game table, a bumper system is sometimes advantageous to have positioned about the gaming surface. Particularly for the game of craps when a shooter repeatedly tosses a pair of dice across the table, the bumpers assist in confining the playing materials to the playing surface. Similarly, when cards are dealt across the table, the bumpers keep the cards from leaving the playing table thereby maintaining smooth game flow. Other game tables have bumper systems that are either permanently affixed about a perimeter of the playing surface or are removably attached to the playing surface. These bumper systems detract from the collapsibility of the gaming table or are generally inconvenient to set up and take down, respectively.

It would therefore be desirable to have a game table and method of altering a game format that is quickly and simply collapsible and provides a plurality of interchangeable game formats.

BRIEF DESCRIPTION OF INVENTION

The present invention is directed to a folding game table that solves the aforementioned problems. The game table has a plurality of table top portions pivotably interconnected to be movable between an extended position and a folded position. A cushion is positioned generally about a perimeter of the game table with a game template interchangeably secured across a play surface of the game table.

Therefore, in accordance with one aspect of the present invention, a folding game table is disclosed that includes a plurality of table top portions and at least one hinge configured to interconnect the plurality of table top portions and configured to permit the plurality of table top portions to be movable between an extended position and a folded position. The folding game table also includes at least one game template detachably mounted to the plurality of table top portions and at least one rail configured to be removably mounted to the plurality of table top portions and configured to removably secure the at least one game template to the plurality of table top portions.

In accordance with another aspect of the present invention, a method of changing games on a game table is disclosed that includes the steps of positioning an interchangeable game pattern on a game table surface and coupling the interchangeable game pattern to the game table surface. The method includes positioning rails about the game table surface and securing the rails to the game table surface.

In accordance with a yet another aspect of the present invention, a single apparatus for playing multiple games is disclosed that includes at least a pair of table sections, means for interconnecting the at least a pair of table sections to form a foldable table, and a game mat removably connectable to the foldable table. The apparatus also includes means for maintaining tautness of the game mat over the foldable table and at least one removable rail secured about the game mat to the foldable table. Additionally, means for anchoring the at least one removable rail to the foldable table is included.

According to yet a further aspect of the present invention, a kit is disclosed that includes a folding game table, a plurality of game templates, and a case constructed to enclose the folding game table and plurality of game templates.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
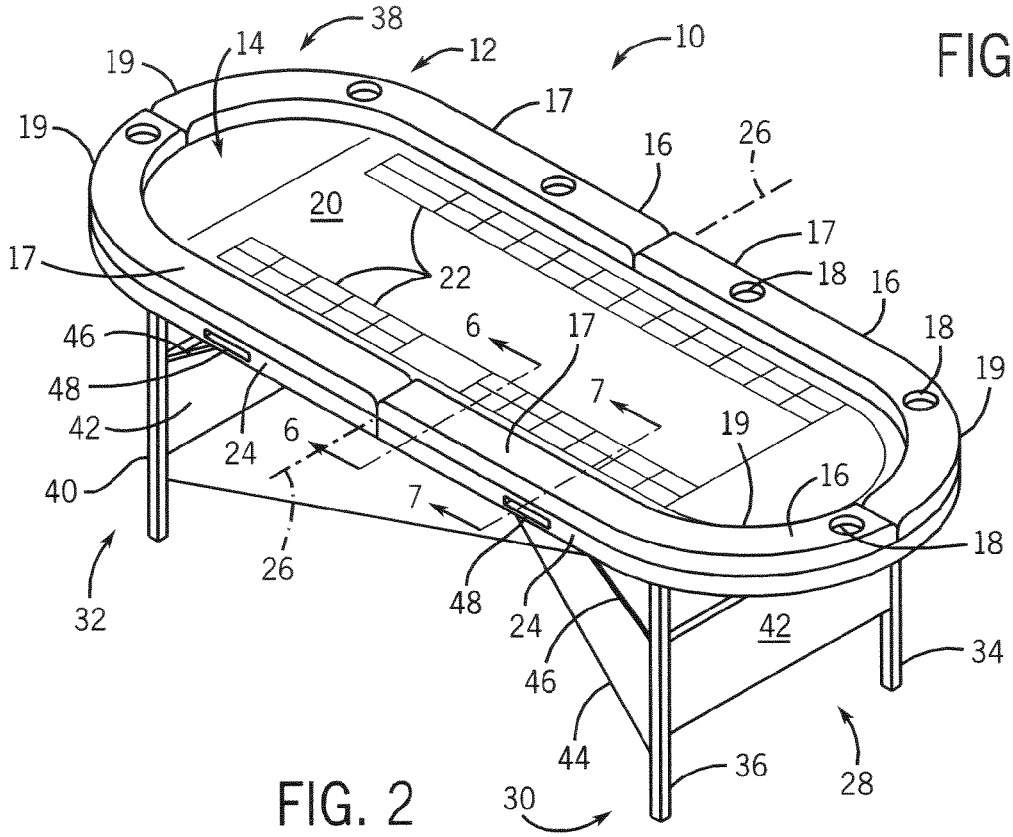
FIG. 1 is a perspective view of a collapsible game table according to the present invention shown in an extended position.

FIG. 1 shows a game table 10 having a rail 12 positioned about a play surface 14. Rail 12 includes a plurality of individual rail sections 16 that cooperate to encompass play surface 14. In a preferred embodiment, four rail sections 16 are combined to form a cushioned rail 12 that encloses play surface 14. Each rail section 16 has a generally straight portion 17 and a generally curved portion 19. The generally straight portion 17 of each rail section 16 abuts the generally straight portion 17 of an adjoining rail section 16, and the generally curved portion 19 of each rail section 16 abuts the generally curved portion 19 of another adjoining rail section 16. Such cooperation effectively encircles play surface 14. A plurality of recesses 18 is formed in rail 12 and configured to provide game players with a storage location for game play ancillaries such as poker chips and/or drinks. Providing player positioning of drinks and chips off of play surface 14 improves the flow of the game and maintains the cleanliness of play surface 14. A game pattern 20 is positioned on play surface 14 and includes game indicia 22. Game indicia 22 include a wide variety of markings associated with game play. Such indicia can include, for example, patterns associated with roulette, blackjack, craps, and poker, to name but a few.

Game table 10 includes a pair of table top sections 24 pivotably connected about a hinge axis 26. A leg assembly 28 includes a first set of legs 30 and a second set of legs 32 generally disposed at opposite ends of game table 10. Each set of legs 30, 32 includes a pair of legs 34, 36 and 38, 40, respectively. A brace 42 extends between legs 34, 36, 38, 40 of each set of legs 30, 32. A strap 44, or cable, extends under game table 10 between diagonally opposite legs of leg assembly 28. Such an orientation reduces interference of strap 44 with players positioned about game table 10 and forms a relatively robust support system of game table 10.

A bracket 46 extends between each set of legs 30, 32 and table top sections 24. Brackets 46 are constructed to allow each set of legs 30, 32 to be folded under table top sections 24 thereby collapsing game table 10 into a generally planar orientation without the legs extending perpendicularly therefrom. Additionally, a pocket 48 is formed into each table top section 24 generally proximate an axis of center of mass of each table top portion. The collapsed orientation of game table 10 is shown in FIG. 2.

Figure 2:
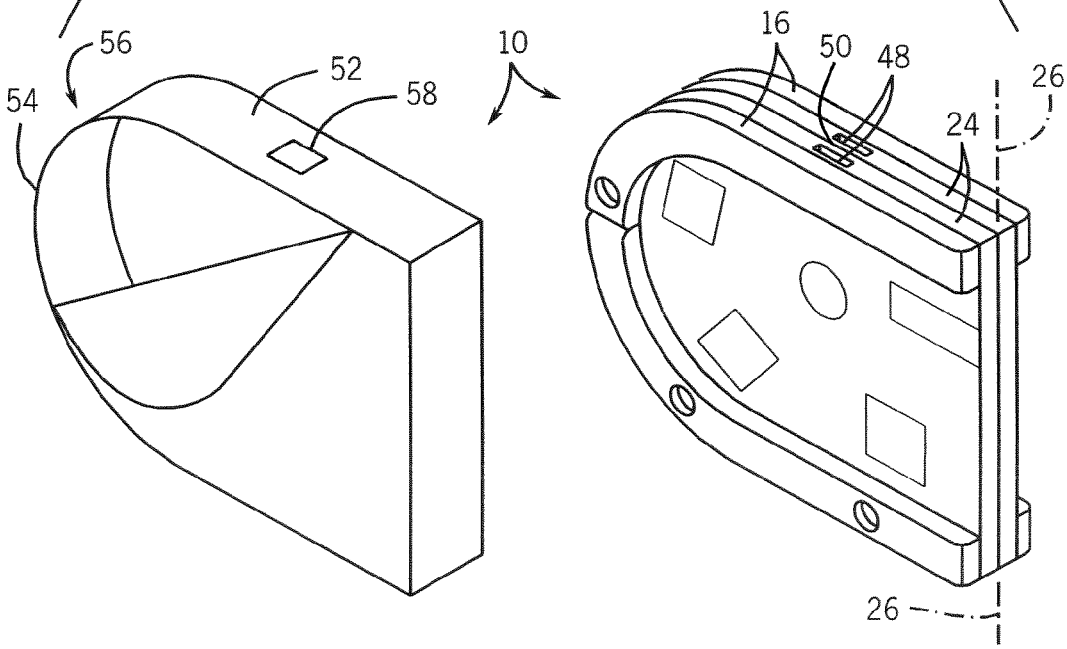
FIG. 2 is a perspective view of the game table shown in FIG. 1 in a collapsed position with an accompanying case.

As shown in FIG. 2, leg assembly 28 folds into table sections 24 and table sections 24 rotate together about hinge axis 26 thereby providing a folded table length that is half of the extended table length shown in FIG. 1. Additionally, when folded together, pockets 48 formed in table sections 24 align to form a handle 50 for easy and efficient handling of game table 10 in the collapsed position. A case 52 is also shown in FIG. 2 and is shaped to snuggly receive folded game table 10 therein. Case 52 includes a zipper 54 located about a perimeter 56 of the case 52 and is constructed to allow quick and efficient removal or insertion of game table 10 into case 52. An opening 58 is formed through case 52 and allows access to handle 50 when game table 10 is positioned in case 52. Alternative to forming opening 58 through case 52, a handle may be attached to case 52 to allow easy and efficient handling thereof.

Figure 3:
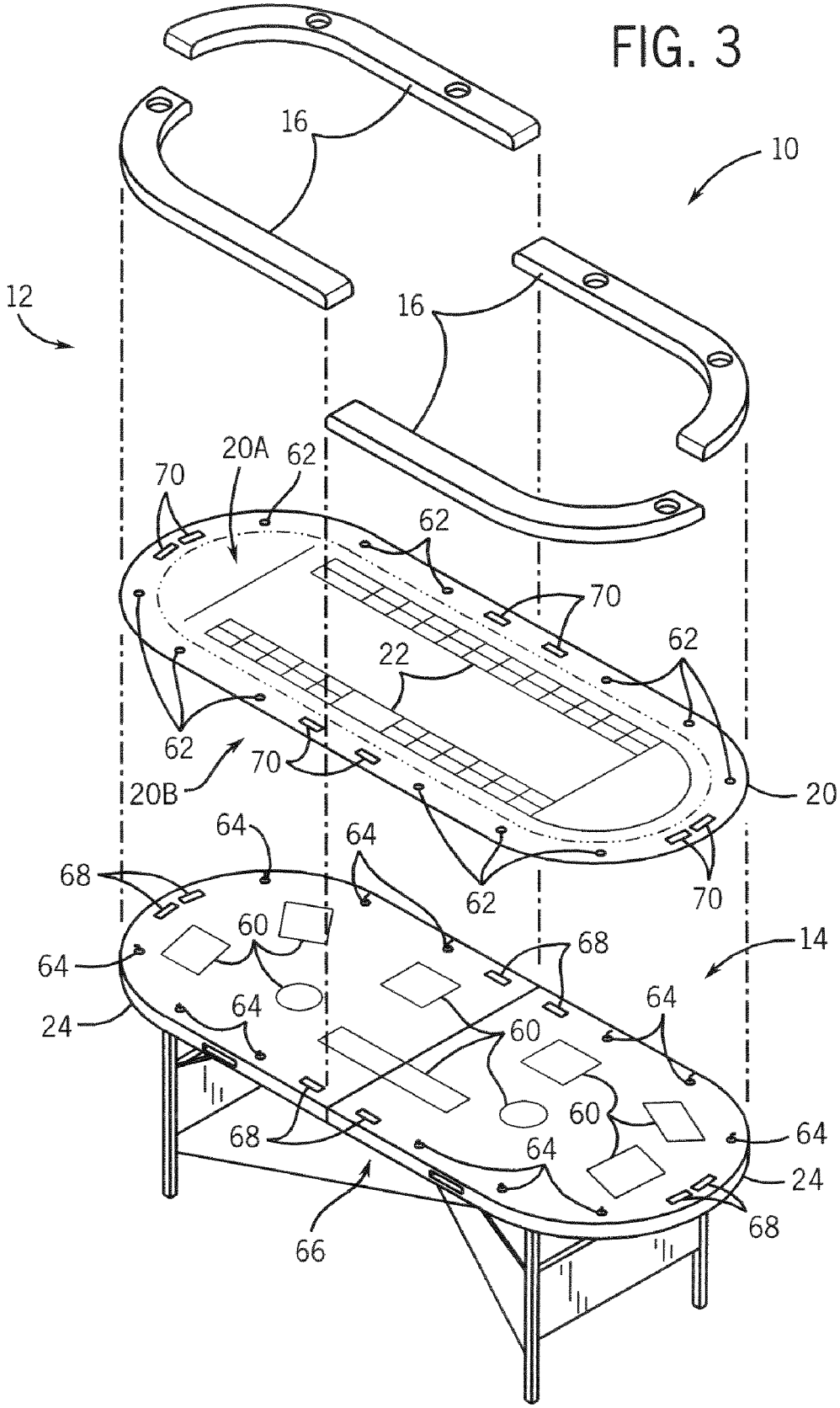
FIG. 3 is a perspective exploded view of the game table shown in FIG. 1.

FIG. 3 shows a perspective exploded view of game table 10. The plurality of individual rail sections 16 is detachably mounted to game table 10 to allow game pattern 20 to be positioned on, and removed from, game table 10. Game pattern 20 has two sides 20A and 20B, each side having game indicia 22 thereon allowing game pattern 20 to be turned over to reveal a different set of game indicia on the opposite side. Game pattern 20 is preferably made of a felt material, although materials such as leather, vinyl, and the like may be used. Additionally, game pattern 20 may be removed from play surface 14 to reveal game indicia 60 on table top sections 24 to allow game play on play surface 14 without game pattern 20 positioned thereon.

To mount game pattern 20 to game table 10, game pattern 20 is placed on play surface 14 with rail 12 removed from game table 10. A plurality of holes 62 is formed in game pattern 20 to allow game pattern 20 to be coupled to a plurality of game pattern retainers 64. Game pattern retainers 64 are preferably hooks, pins, or clips and are attached to game table 10 about a perimeter 66 of table top sections 24. In a preferred embodiment, game pattern 20 is stretched tightly over play surface 14 to minimize wrinkles or slack in game pattern 20. Game pattern retainers 64 preferably maintain a stretched or taut position of game pattern 20 over play surface 14. Rail 12 is connected to game table 10 over game pattern 20. A plurality of apertures 68 is formed in table top sections 24 and is discussed further below with respect to FIG. 6. Game pattern 20 has a plurality of latch openings 70 formed therein, each latch opening 70 substantially overlaps a corresponding aperture 68.

Game pattern 20 is removable for changing of game indicia 22 of side 20A and for folding of game table 10. Game pattern 20 may be removed from game table 10 by removing rails 16 from game table 10. With rails 16 removed, game pattern 20 may be de-coupled from game pattern retainers 64. Game pattern 20 can be turned over to reveal a different game pattern illustrated on the opposite side 20B or stored to expose game indicia 60.

Figure 4:
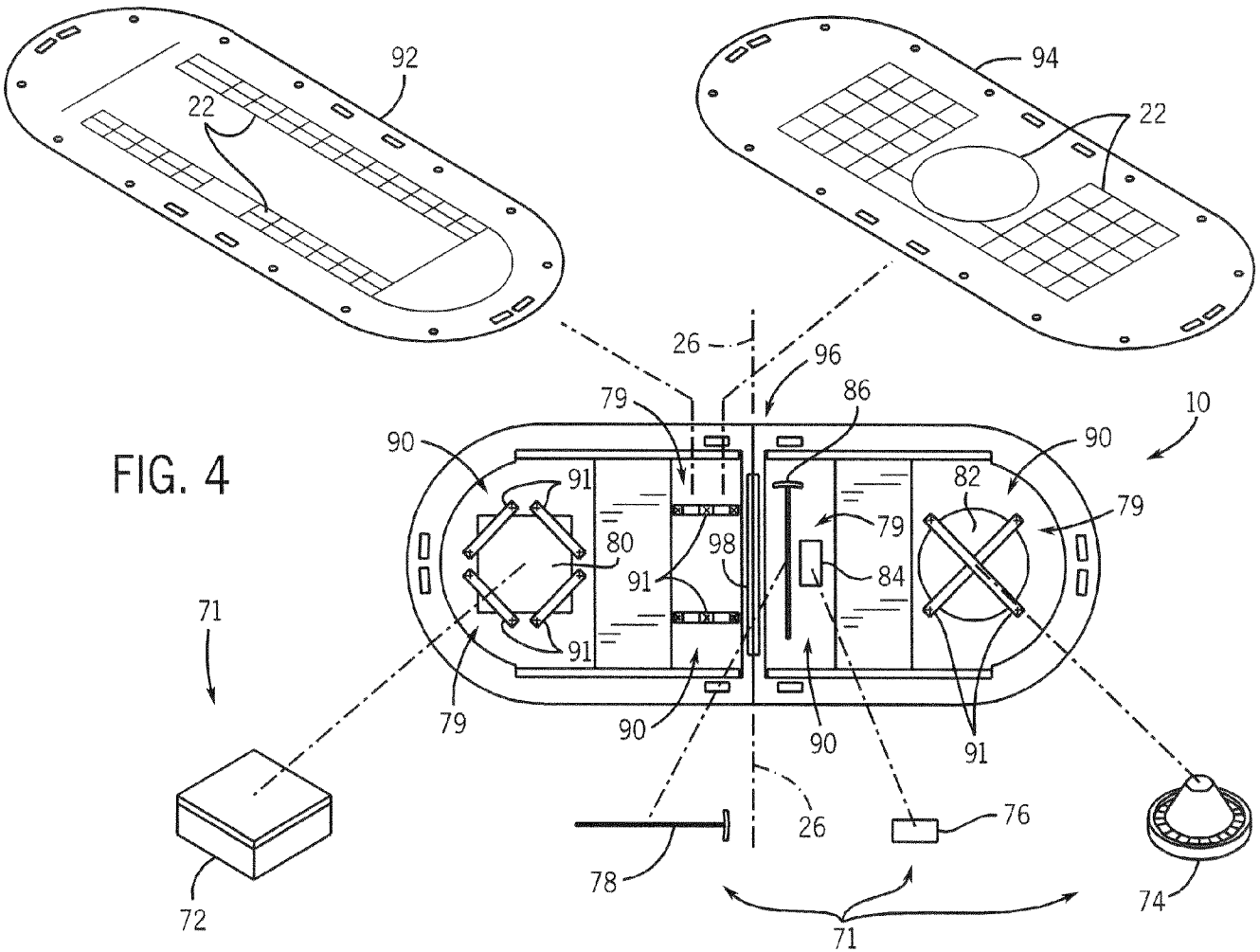
FIG. 4 is a bottom view of the game table shown in FIG. 1 with a variety of game accessories removed therefrom.

FIG. 4 shows a bottom view of game table 10 where a plurality of game accessories 71 may be stored when not in use. Examples of game accessories that may be required to play some of the games indicated by game indicia 22, 60 include: poker chips placed in box 72; a roulette wheel 74; dice, cards, roulette balls, and other items placed in box 76; and a craps stick 78. A plurality of storage locations 79 receives game accessories 71. Storage locations 79 are constructed to snuggly receive a respective game accessory 71 therein. Storage locations 79 include a square-shaped cavity 80 to receive box 72, a circle-shaped cavity 82 to receive roulette wheel 74, a rectangular-shaped cavity 84 to receive box 76, and a cavity 86 to receive craps stick 78. Furthermore, a cavity (not shown) may be formed in game table 10 to receive case 52 when game table 10 is removed therefrom. The game accessories and storage locations listed above are not intended to be a complete list of possible combinations usable with game table 10. Other game accessories and storage locations are within the scope of the claims.

A retaining system 90 is used to secure game accessories 71 in storage locations 79 of game table 10. Retaining system 90 includes a plurality of straps 91, for example, to secure box 72, roulette wheel 74, and game patterns 92, 94 in each respective storage location. Straps 91 may be made of a non-elastic material such as leather or webbing and may be connectable to game table 10 through the use of snaps, interlocking hook and loop fasteners, and the like. Straps 91 may also be made of an elastic material and may be permanently secured to game table 10. Retaining system 90 may also include forming the shapes of cavities 84 and 86 to closely match the shape of game accessories 76 and 78 such that friction secures game accessories 76 and 78 therein. Rubber, foam, or other similar material may also be placed in cavities 84 and 86 to secure the game accessories 76 and 78 therein. For example, rectangular-shaped cavity 84 may frictionally secure box 76 simply by pushing or pressing box 76 therein, and cavity 86 may frictionally secure craps stick 78 by pressing craps stick 78 into cavity 84.

FIG. 4 also shows a hinge assembly 96 attached to table top sections 24. Hinge assembly 96 interconnects table top sections 24 and allows table top sections 24 to pivot about hinge axis 26. Hinge assembly 96 may include a single hinge 98, as shown in FIG. 4, or multiple hinges 100 and 102, as shown in FIG. 5.

Figure 5:
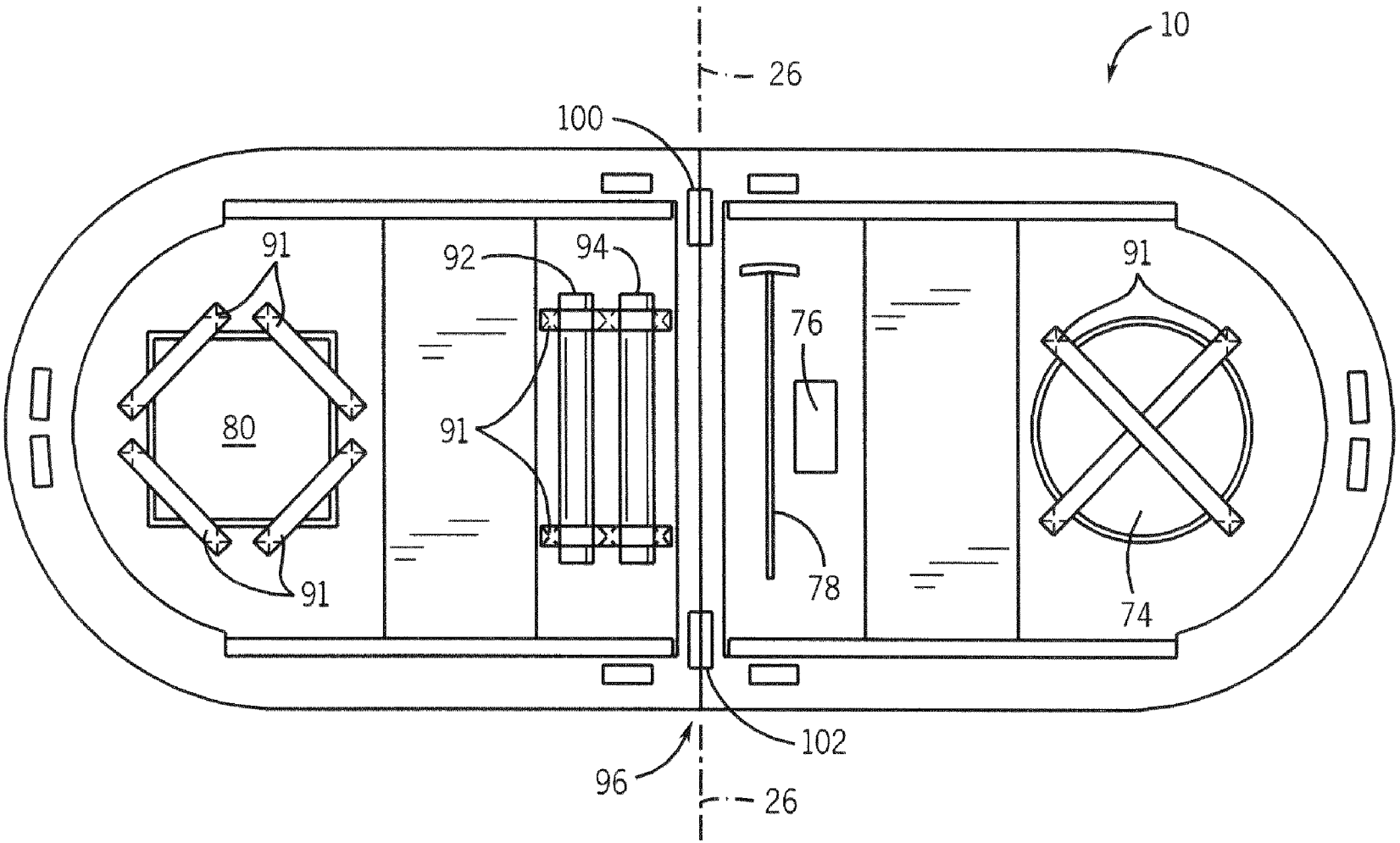
FIG. 5 is a bottom view of the game table shown in FIG. 4 with the game accessories positioned in the game table.

FIG. 5 shows game accessories 71 of FIG. 4 secured to game table 10 in each respective storage location 79. Box 72, roulette wheel 74, and game patterns 92, 94 are secured using straps 91. Cavities 84 and 86 are constructed to frictionally secure box 76 and craps stick 78 therein.

Figure 6:
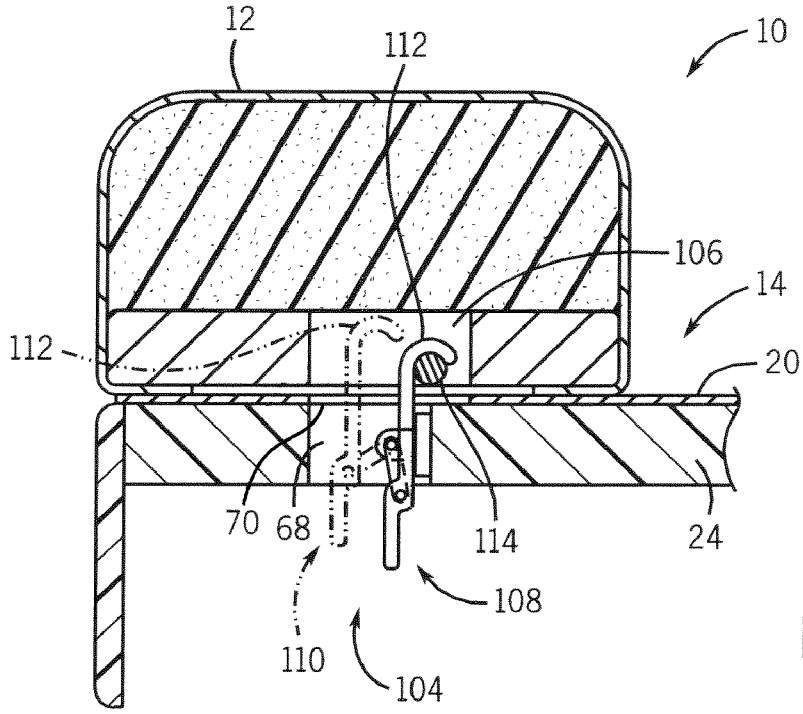
FIG. 6 is a cross-sectional side elevational view of a portion of the game table along line 6—6 of FIG. 1 showing a bumper latch assembly.

As previously referred to, FIG. 6 shows, in part, a cross-sectional view of aperture 68 of table top section 24. A latch assembly 104 is attached to game table 10 within aperture 68. Latch assembly 104 extends through latch opening 70 of game pattern 20 and into a latch cavity 106 formed in rail 12. Latch cavity 106 allows a hook end 112 of latch assembly 104 to pass therein. Latch assembly 104 is preferably a pivotable hook latch. Latch assembly 104 has a latched position 108 and an unlatched position 110. In the latched position 108, hook end 112 of latch assembly 104 engages a catch 114 attached to rail 12 and secures rail 12 to game table 10. In the unlatched position 110, hook end 112 of latch assembly 104 is disengaged from catch 114 such that rail 12 may be removed from play surface 14.

Figure 7:
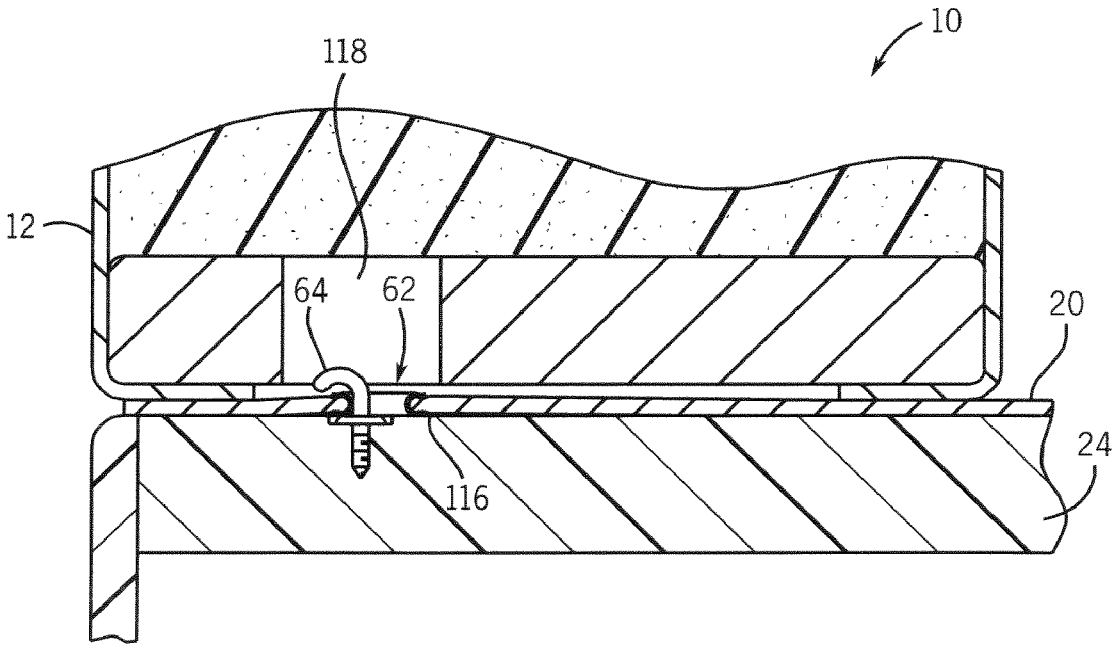
FIG. 7 is a cross-sectional side elevational view of a portion of the game table along line 7—7 of FIG. 1 showing a game template hook assembly.

FIG. 7 shows game pattern 20 secured to game table 10 with a game pattern retainer 64. Game pattern retainer 64 is mounted to game table 10 so as to securely maintain a stretched position of game pattern 20 when game pattern 20 is attached thereto. A grommet 116 is affixed to game pattern 20 about hole 62 and provides strength and support to the connection of game pattern 20 to game pattern retainer 64. In this manner, potential tearing or deformation of game pattern 20 is reduced. A cavity 118 is formed in rail 12 and allows game pattern retainer 64 to extend therein while allowing rail 12 to rest snuggly about game pattern 20.

In accordance with one embodiment of the present invention, a folding game table is disclosed that includes a plurality of table top portions and at least one hinge configured to interconnect the plurality of table top portions and configured to permit the plurality of table top portions to be movable between an extended position and a folded position. The folding game table also includes at least one game template detachably mounted to the plurality of table top portions and at least one rail configured to be removably mounted to the plurality of table top portions and configured to removably secure the at least one game template to the plurality of table top portions.

In accordance with another embodiment of the present invention, a method of changing games on a game table is disclosed that includes the steps of positioning an interchangeable game pattern on a game table surface and coupling the interchangeable game pattern to the game table surface. The method includes positioning rails about the game table surface and securing the rails to the game table surface.

In accordance with a yet another embodiment of the present invention, a single apparatus for playing multiple games is disclosed that includes at least a pair of table sections, means for interconnecting the at least a pair of table sections to form a foldable table, and a game mat removably connectable to the foldable table. The apparatus also includes means for maintaining tautness of the game mat over the foldable table and at least one removable rail secured about the game mat to the foldable table. Additionally, means for anchoring the at least one removable rail to the foldable table is included.

According to yet a further embodiment of the present invention, a kit is disclosed that includes a folding game table, a plurality of game templates, and a case constructed to enclose the folding game table and plurality of game templates.

The present invention has been described in terms of the preferred embodiment, and it is recognized that equivalents, alternatives, and modifications, aside from those expressly stated, are possible and within the scope of the appending claims.

What is claimed is:

1. A folding game table comprising:

a plurality of table top portions;

at least one hinge configured to interconnect the plurality of table top portions and configured to permit the plurality of table top portions to be movable between an extended position and a folded position;

at least one game template detachably mounted to the plurality of table top portions;

a plurality of hooks mounted to the plurality of table top portions and constructed to maintain a stretched orientation of the at least one game template over the plurality of table top portions; and at least one rail configured to be removably mounted to the plurality of table top portions and configured to removably secure the at least one game template to the plurality of table top portions.

2. The folding game table of claim 1 wherein the at least one game template comprises a first side and a second side, each of the first and the second sides having indicia defining a game thereon.

3. The folding game table of claim 2 wherein the at least one game template is constructed of at least one of a felt material, a leather material, and a vinyl material.

4. The folding game table of claim 1 further comprising a plurality of rails.

5. The folding game table of claim 4 further comprising four rails, each rail having a generally straight portion at one end and a curved portion at another end.

6. The folding game table of claim 1 wherein the at least one game template has holes formed therein arranged to engage the plurality of hooks.

7. The folding game table of claim 1 wherein the at least one rail has a cavity formed therein constructed to receive at least one of the plurality of hooks when the at least one rail is positioned about the plurality of table top portions.

8. The folding game table of claim 1 wherein the plurality of table top portions includes indicia defining at least one game thereon.

9. The folding game table of claim 1 further comprising a plurality of foldable legs, each leg attached to at least one of the plurality of table top portions and constructed to support the folding game table when extended and storable within a storage volume when collapsed.

10. The folding game table of claim 1 further comprising at least one accessory cavity formed in at least one of the plurality of table top portions and constructed to receive at least one game accessory.

11. The folding game table of claim 10 further comprising a retention system attached to the folding game table and constructed to secure the at least one game accessory within the at least one accessory cavity.

12. The folding game table of claim 1 wherein the at least one rail is positioned about an outer edge of a respective table top portion when mounted thereto.

13. The folding game table of claim 12 wherein each of the plurality of table top portions has at least one latching assembly connected thereto, the at least one latching assembly constructed to secure the at least one rail to the table top portion.

14. The folding game table of claim 13 wherein the at least one rail has a cavity formed in a portion thereof, the cavity constructed to substantially overlap a respective latching assembly when the at least one rail is positioned about the table top portion.

15. The folding game table of claim 13 wherein the at least one game template has at least one latch opening formed therein, the at least one latch opening constructed to substantially overlap a respective latching assembly and allow uninterrupted passage of the respective latching assembly therethrough.

16. The folding game table of claim 1 further comprising a handle formed in at least one of the plurality of table top portions.

17. A folding game table comprising:

a plurality of table top portions;

at least one hinge configured to interconnect the plurality of table top portions and configured to permit the plurality of table top portions to be movable between an extended position and a folded position;

at least one game template detachably mounted to the plurality of table top portions;

at least one rail configured to be removably mounted to the plurality of table top portions and configured to removably secure the at least one game template to the plurality of table top portions, wherein the at least one rail is positioned about an outer edge of a respective table top portion when mounted thereto;

wherein each of the plurality of table top portions has at least one latching assembly connected thereto, the at least one latching assembly constructed to secure the at least one rail to the table top portion; and wherein the at least one rail has a cavity formed in a portion thereof, the cavity constructed to substantially overlap a respective latching assembly when the at least one rail is positioned about the table top portion.

18. The folding game table of claim 17 wherein the at least one game template has at least one latch opening formed therein, the at least one latch opening constructed to substantially overlap a respective latching assembly and allow uninterrupted passage of the respective latching assembly therethrough.

* * * * *